United States Patent [19]

Chernack

[11] Patent Number: 4,779,175

[45] Date of Patent: Oct. 18, 1988

[54] LAMP

[75] Inventor: Milton P. Chernack, West Hempstead, N.Y.

[73] Assignee: Neon Modular Systems, Inc.

[21] Appl. No.: 24,249

[22] Filed: Mar. 10, 1987

[51] Int. Cl.[4] ..... F21V 19/02

[52] U.S. Cl. ..... 362/220; 362/285; 362/287; 362/396

[58] Field of Search ..... 362/220, 263, 285, 287, 362/396

[56] References Cited

U.S. PATENT DOCUMENTS 778,274 12/1904 Rue ..... 362/396
1,261,894 4/1918 Barnes ..... 362/396
4,478,484 10/1984 Pratt, Jr. ..... 362/263
4,652,983 3/1987 Mytels ..... 362/220

*Primary Examiner*—Larry I. Schwartz
*Attorney, Agent, or Firm*—Cohen, Pontani & Lieberman

[57] ABSTRACT

A lamp of simple construction for selectively supporting a bulb or bulbs in multiple positions, wherein the bulbs are illuminating tubes such as fluorescent or neon tubes and the lamp does not substantially interfere with the illumination radiating from the bulb or bulbs. The lamp is generally comprised of a frame and at least one bulb holder located along the frame. The bulb holder is provided with an aperture for slidably receiving and holding the bulb to be supported, the bulb thereby being held by the bulb holder and supported by the frame.

25 Claims, 5 Drawing Sheets

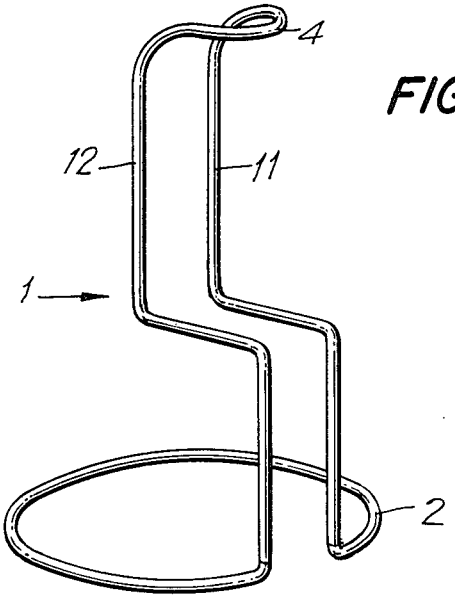
FIG. 1
FIG. 2
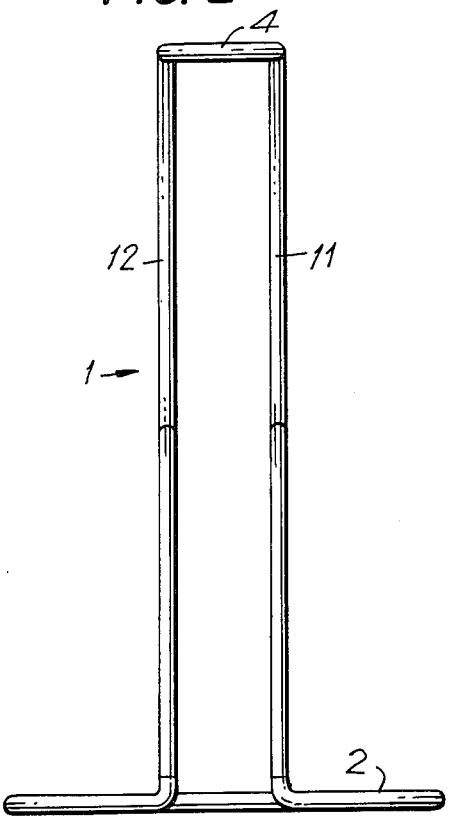
FIG. 3
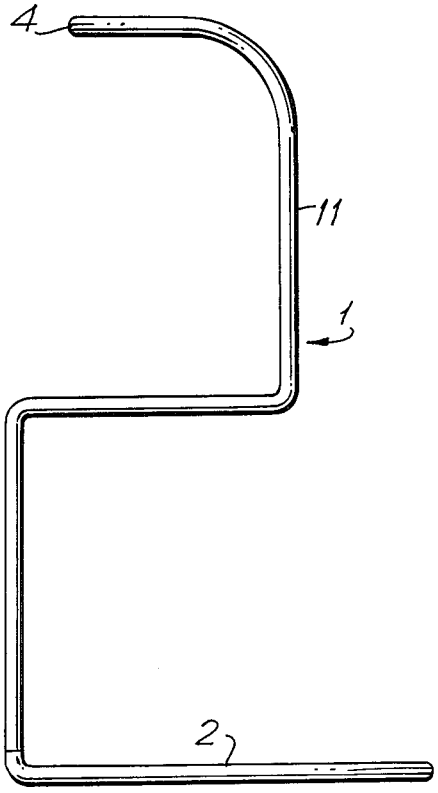

FIG. 4
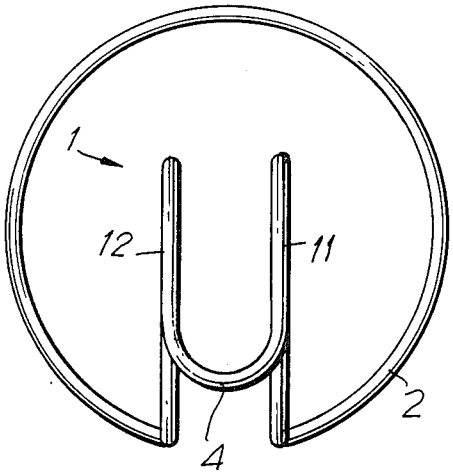
FIG. 5
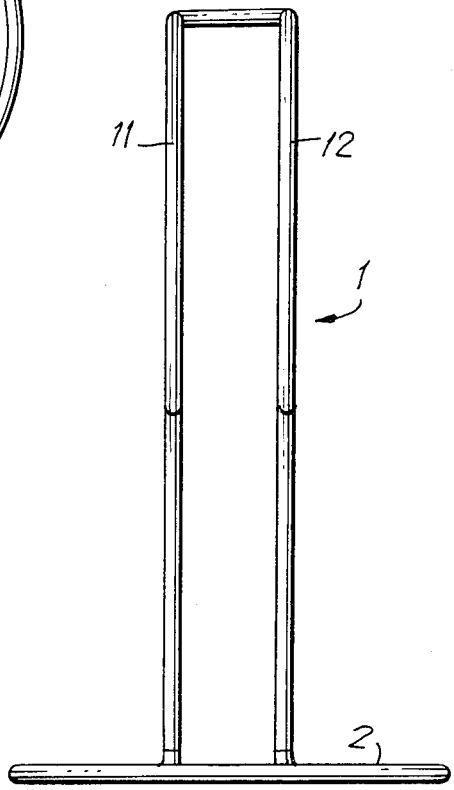
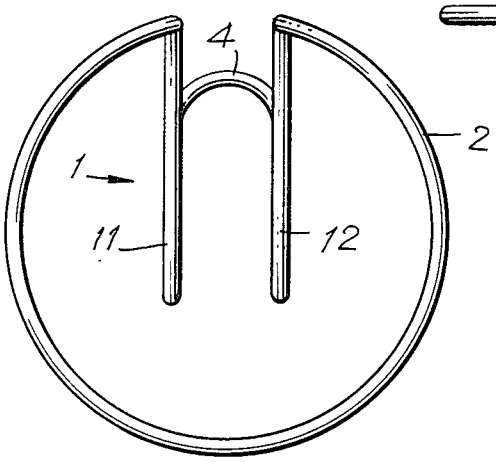
FIG. 6

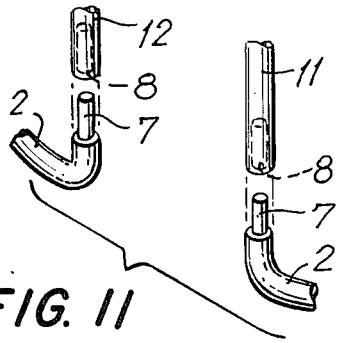
FIG. 11
FIG. 12
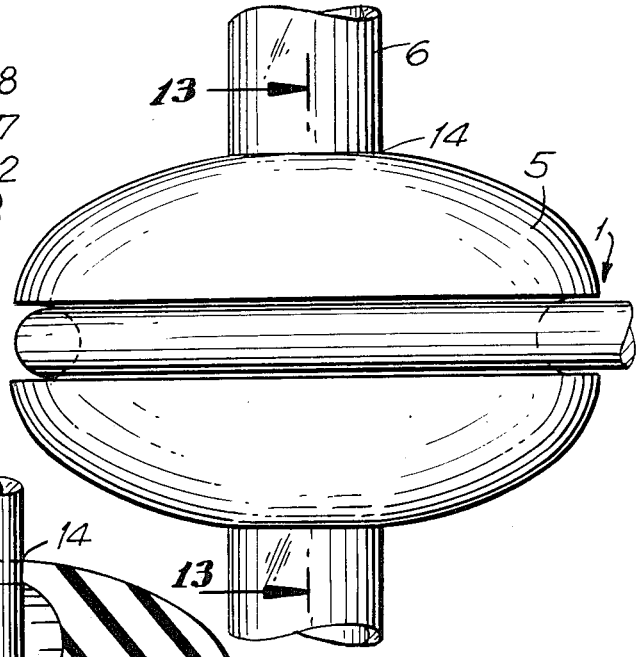
FIG. 13
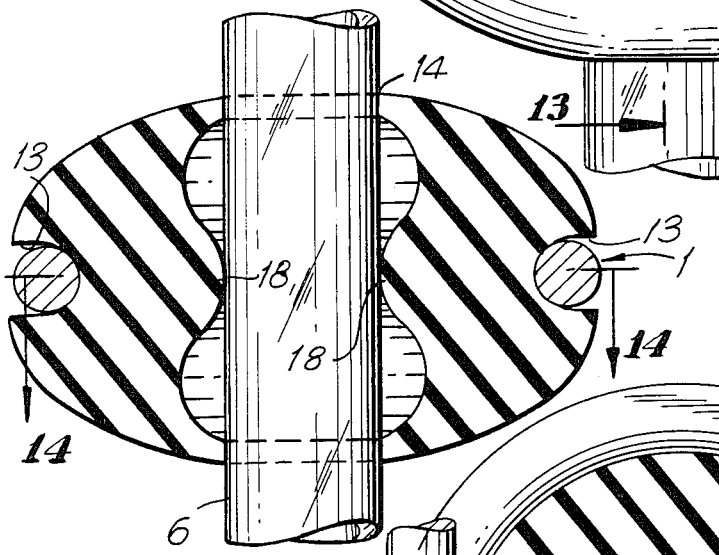
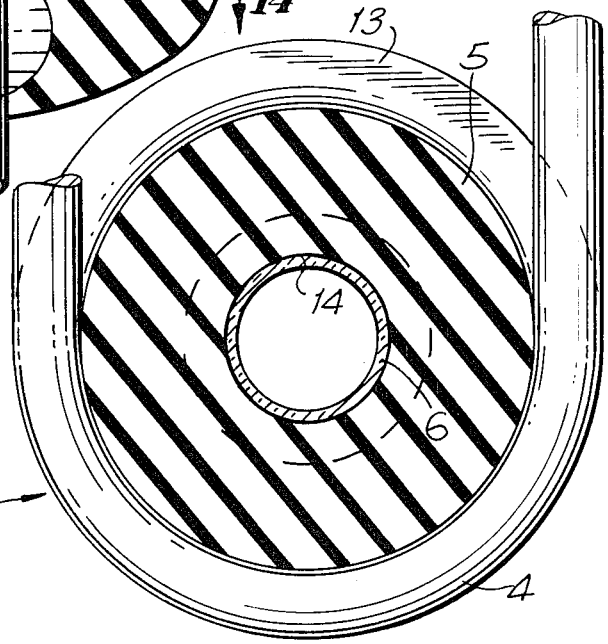
FIG. 14

FIG. 15
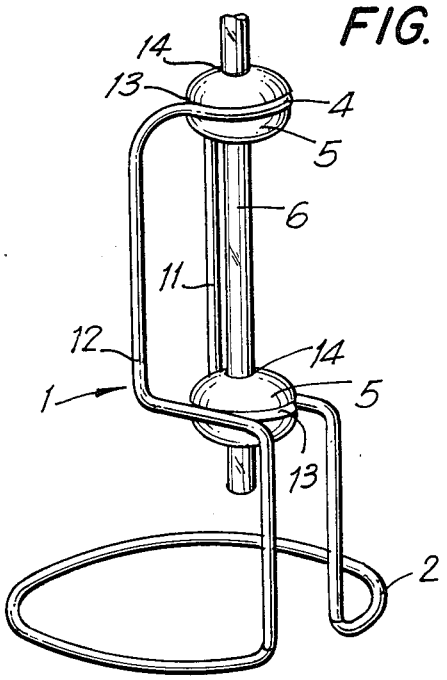
FIG. 16
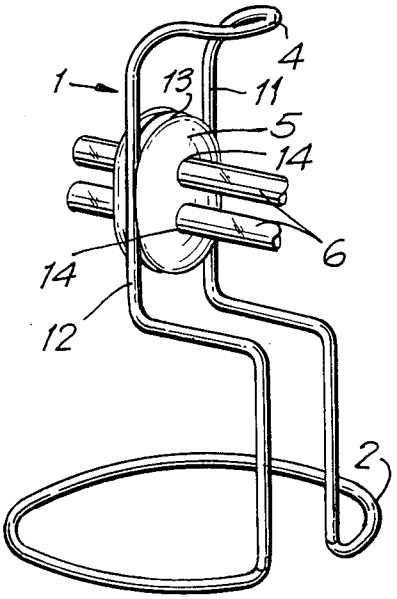
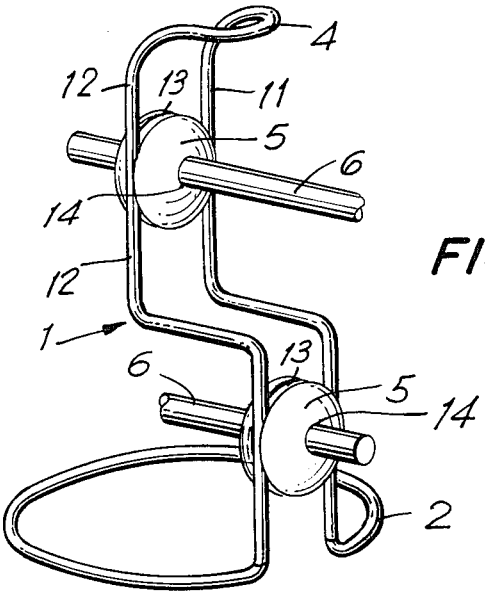
FIG. 17

LAMP

FIELD OF THE INVENTION

The invention relates generally to a lamp and especially to a lamp for selectively supporting a bulb in multiple positions. More particularly, the invention relates to a lamp for selectively supporting an elongated tubular bulb in multiple positions.

SUMMARY OF THE INVENTION

It is an object of this invention to provide a lamp for selectively supporting a bulb in multiple positions.

It is another object of this invention to provide a lamp of simple construction for selectively supporting a bulb in multiple positions.

It is another object of this invention to provide a lamp for selectively supporting a bulb in multiple positions without substantially interfering with the illumination radiating therefrom.

It is another object of this invention to provide a lamp for selectively supporting an elongated tubular bulb in multiple positions.

It is another object of this invention to provide a lamp for selectively supporting a neon tube in multiple positions.

The lamp is defined by a frame and has a bulb holder selectively located along and attached to the frame. The bulb holder is provided with an aperture for slidably receiving and holding a bulb.

For a better understanding of the present invention, together with other objects, reference is made to the following description, taken in conjunction with the accompanying drawings, and the scope of the invention will be pointed out in the appended claims.

BRIEF DESCRIPTION OF THE DRAWINGS

FIG. 1 is a perspective view of the preferred embodiment of the lamp without bulb or bulb holder;

FIG. 2 is a front elevational view of the preferred embodiment of the lamp shown in FIG. 1;

FIG. 3 is a side elevational view of the preferred embodiment of the lamp shown in FIG. 1;

FIG. 4 is a top plan view of the preferred embodiment of the lamp shown in FIG. 1;

FIG. 5 is a rear view of the preferred embodiment of the lamp shown in FIG. 1;

FIG. 6 is a bottom view of the preferred embodiment of the lamp shown in FIG. 1;

FIG. 11 is a detailed perspective view of the lamp illustrating a preferred mode of attachment of the frame to the base;

FIG. 12 is a fragmentary detailed side view of the preferred embodiment illustrating in enlarged scale the bulb holder and bulb on the stand;

FIG. 13 is a sectional view taken along line 13—13 of FIG. 12;

FIG. 14 is a top plan view of FIG. 12;

FIG. 15 is a perspective view of the preferred embodiment showing an elongated tubular bulb held by two bulb holders;

FIG. 16 is a perspective view of the preferred embodiment showing a bulb holder having two apertures holding two bulbs; and FIG. 17 is a perspective view of the preferred embodiment showing two bulbs held by two bulb holders.

DETAILED DESCRIPTION OF THE PREFERRED EMBODIMENT

Figure 7:
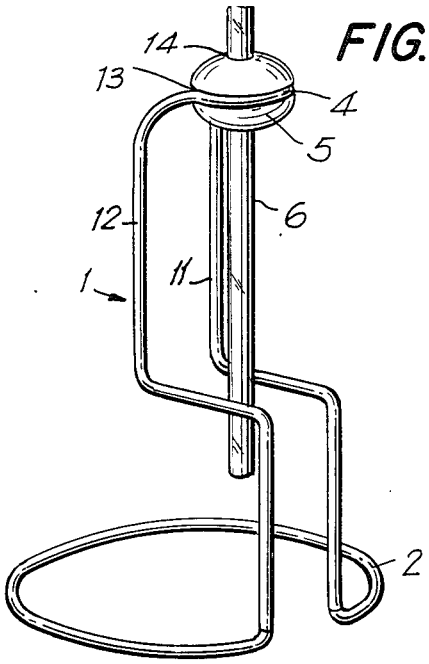
FIGS. 7, 8, 9 and 10 are perspective views of the preferred embodiment, each showing the bulb and bulb holder in a different position.

The present invention is directed to a device for selectively supporting a bulb or a plurality of lamps or bulbs (hereinafter bulbs) in multiple positions. In particular, the invention is directed to a simple structure for supporting an elongated tubular bulb, such as a fluorescent or neon tube, in multiple positions without substantially interfering with the illumination radiated by the bulb. Generally, a bulb holder is attached to a frame and the bulb is selectively inserted through the bulb holder. The bulb is thereby held by the bulb holder and supported by the frame.

More specifically, and with reference to the accompanying drawings, in the preferred embodiment of the invention described herein and depicted in the drawings, a frame 1 is comprised of parallel tracks 11 and 12 constructed of any suitable material that is capable of maintaining its shape and of supporting the weight of the bulb 6. Such materials include, but are not limited to, metal and plastic. The tracks 11 and 12 are preferably wire, rod or tube-like and may be of any shape in cross-section, including circular and square. In the preferred embodiment, parallel tracks 11 and 12 have a circular cross-section of one-half inch diameter. The size and shape of the cross-section of tracks 11 and 12 is not intended to be limited, but it is preferred that the frame 1 not substantially interfere with the illumination radiated by the bulb. Therefore, the tracks 11 and 12 of the frame 1 should be constructed such that bulb holder 5 may be easily mounted on the tracks 11 and 12 and further that the frame 1 be sufficiently strong so as to support the weight of the bulb 6. Otherwise, tracks 11 and 12 are preferably of minimal size in cross-section.

The frame 1 may be free standing on, or attached or attachable to, a suitable structure, such as a floor, wall, ceiling or base. In the preferred embodiment, the frame 1 is attached to a base 2 which provides a stable footing for the frame 1. The preferred base 2 depicted in the drawings and described herein is constructed to be connected to the tracks 11 and 12, so as to form a unitary appearing structure. However, it can readily be seen by those skilled in the art that the base 2 may be of many alternate forms. If desired, the frame 1 may also be removably attached to the base, such that the frame and base are separable. FIG. 11 illustrates an arrangement which may be utilized to provide for a separable or detachable frame 1 and base 2 in the preferred embodiment. The base 2 is preferably formed of the same material as frame 1 and therefore, is preferably wire, rod or tube-like, the wire, rod or tube being formed into a base circle with the free ends upstanding and spaced apart the distance between the tracks 11 and 12. The free ends of base 2 are provided with pins 7, which may or may not be integral with the base 2, and which are complementary to cavities 8 in the free ends of tracks 11 and 12. By inserting pins 7 into cavities 8, connection between base 2 and frame 1 is effected. Of course it can be readily seen that such an arrangement could be reversed whereby tracks 11 and 12 are provided with pins which could be inserted into holes or cavities in the free ends of base 2. Numerous other connecting means may be employed. Indeed, if desired, the base 2 and frame 1 may be integral.

In the preferred embodiment, the frame 1 with its base 2 is shaped somewhat like a stylized numeral two in side elevation view as shown in FIG. 3. This shape allows for the bulb 6 to be supported in many different positions while frame 1 stands upright and is advantageous because it provides two horizontal spaced apart track sections for vertical positioning of the bulb 6 and two vertical spaced apart track sections for horizontal positioning of bulb 6. In the preferred embodiment, tracks 11 and 12 of the frame 1 are constructed of a single length of wire, rod or tube, preferably rod. The rod is curved at the top 4 of frame 1 to space the parallel tracks 11 and 12. Of course, other shapes and arrangements of the frame 1 are contemplated, and the invention is not intended to be limited by the description of the preferred embodiment. In particular, an alternate shape the frame 1 may take in side elevation is circular, such a shape allowing a bulb 6 to be supported at any angle.

A bulb holder 5, is preferably in the form of a grommet having a groove 13 formed therein along the equator. As shown, groove 13 is complementary to a portion of the cross section of the tracks 11 and 12. In the preferred embodiment, as best seen in FIG. 13, the bulb holder 5 is proportional so that tracks 11 and 12 fit within diametrically opposed portions of groove 13 to releasably hold the grommet for sliding movement along tracks 11 and 12 while releasably restraining the grommet when left stationary.

In the preferred embodiment, the bulb holder 5 is constructed of rubber, but it should be apparent to those skilled in the art that the bulb holder 5 may be constructed of other materials, plastic being an example of one such alternate material. However, elastomeric materials, such as rubber, serve to enhance the releasable holding capability of the bulb holder 5 on the tracks and of the bulb on the bulb holder.

The bulb holder 5 is provided with an aperture 14 of suitable diameter to slidably receive bulb 6. In the preferred embodiment, the aperture 14 corresponds in size and shape to the cross-section of the bulb 6. Preferably bulb 6 is an illuminating tube such as a fluorescent or neon tube. Such tubes are usually circular in cross-section, and therefore, aperture 14 of bulb holder 5 is preferably circular in the preferred embodiment. As illustrated in FIGS. 12, 13 and 14, the aperture 14 corresponds in size and shape to the cross-section of the bulb 6 and is centrally located in bulb holder 5, although it may be eccentrically located. Likewise, in another embodiment (not shown) wherein the bulb holder 5 is, for example, rectangular in plan view, the aperture 14 may be located centrally or other than centrally. A sufficient interior surface area of the aperture 14 should contact the bulb 6 when bulb 6 is inserted through the aperture 14 to securely hold the bulb 6 in place.

FIG. 13 illustrates an additional preferred, but optional, feature of the bulb holder 5 for securely engaging bulb 6. In this embodiment, the interior of the aperture 14 of the bulb holder 5 is contoured to define a nub 18 about the central portion of the aperture 14. The diameter of the aperture 14 at nub 18 is slightly less than the outside diameter of the bulb 6. Because the bulb holder 5 is constructed of a pliable or elastomeric material such as rubber, nub 18 is compressed when the bulb 6 is inserted through the aperture 14 and the nub 18 is thereby biased to securely grip bulb 6.

Figure 8:
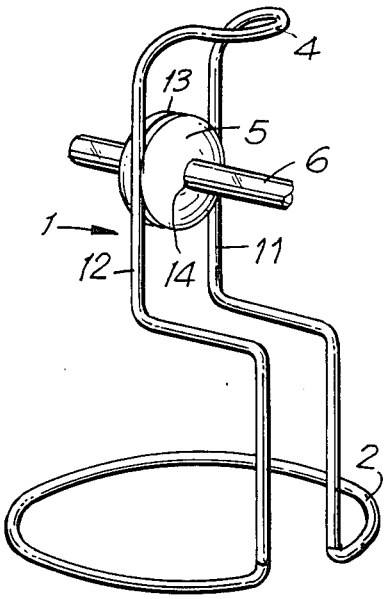
Figure 9:
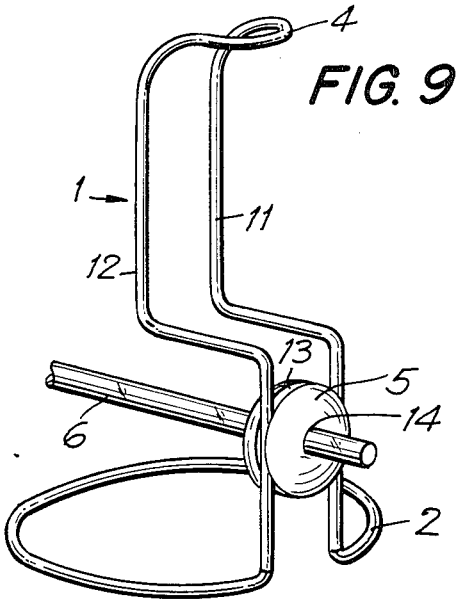
Figure 10:
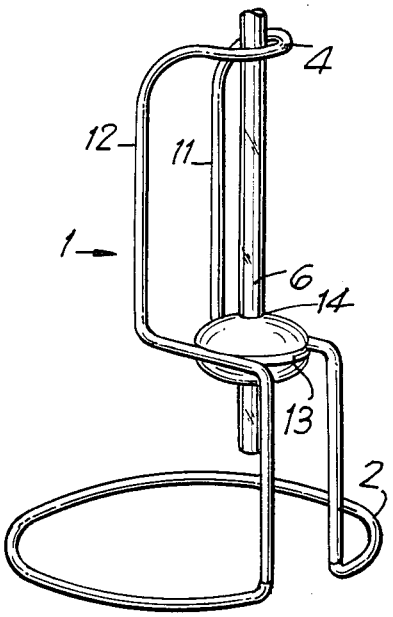

As can be seen from the foregoing description, the bulb holder 5 may be located, in the preferred embodiment, at any position along parallel tracks 11 and 12. Thus, in the preferred embodiment, wherein the frame 1 and base 2 are shaped as illustrated in FIGS. 1–10, the bulb holder 5 may be selectively located in multiple positions on the frame 1 thereby allowing the bulb 6 to be oriented either vertically as shown in FIGS. 7 and 10, or horizontally as shown in FIGS. 8 and 9. Moreover, as can be seen in the drawings, the bulb 6 can be located at different levels. It oan readily be seen by those skilled in the art that in alternate embodiments, wherein the frame 1 is of another shape, the bulb 6 may be oriented at any angle that the shape or the arrangement of the frame 1 permits.

Because of the slidable mounting, bulb 6 is selectively longitudinally positionable in bulb holder 5. Thus, in the preferred embodiment, wherein bulb 6 is an elongated tube, the bulb holder 5 may hold the bulb 6 at different points along the length of the tube. The elongaged bulb 6 may therefore be held by the bulb holder 5 at its midpoint such that equal lengths of the elongated bulb 6 extend from either side of the bulb holder as shown in FIG. 7. Bulb 6 may also be held by the bulb holder 5 such that the bulb 6 extends a greater length on one side of the bulb holder 5 and a lesser length on the other side of the bulb holder 5 as shown in FIGS. 8–10. The only limitation on longitudinal positioning of the bulb, if any, is the question of stability or balance, especially where the lamp is not fixed to a support but is connected to a base like base 2. This enables light to be directed where the user chooses.

Preferably, and as shown, the bulb holder 5 is removably attached to the frame 1, and can therefore be removed and repositioned at any point along the frame 1, without sliding, if desired. The means of attachment utilized in the preferred embodiment is particularly suited to this purpose, in that the bulb holder 5 may easily be disengaged from the tracks 11 and 12 by compressing the rubber grommet and repositioning it at any other point along parallel tracks 11 and 12. Similarly, as already noted, bulb 6 is held securely by the bulb holder 5, but the bulb 6 may be removed or repositioned easily.

While there has been shown and described only one preferred form of the invention, it will be understood that various omissions and substitutions and changes in the form and details of the device illustrated and described may be made by those skilled in the art without departing from the spirit of the invention.

For example, more than one bulb holder 5 may be used to support a single bulb 6. As shown in FIG. 15, the shaped frame 1 of the preferred embodiment may have a bulb holder 5 located at the top 4 of the frame 1 and a second bulb holder 5 located below the first bulb holder 5 such that a bulb 6 may be inserted through the apertures 14 of both bulb holders and may therefore be held in place by both bulb holders.

More than on bulb 6 may be supported by the lamp by utilizing more than one bulb holder 5 located along the frame 1, each bulb holder 5 holding a bulb 6 as shown in FIG. 17. Alternately a bulb holder 5 with more than one aperture 14 may be used to slidably receive and hold more than one bulb 6 as shown in FIG. 16.

Many additional modifications ar possible and are contemplated in implementing the device of the invention. It is the intention, therefore, to be limited only as indicated by the scope of the claims appended hereto.

What is claimed is:

1. A lamp for selectively supporting a bulb in multiple positions, said lamp comprising a frame having substantially parallel tracks and a bulb holder removably attached to said frame at a selected position along said frame, said bulb holder having one or more grooves for engaging said tracks when said bulb holder is fitted between said tracks, said bulb holder further having an aperture for slidably receiving and holding said bulb, said bulb being longitudinally selectively positionable when inserted through said aperture such that said bulb is releasably held by said bulb holder and is supported by said frame.

2. The lamp of claim 1, wherein the tracks are wire, rod or tube-like.

3. The lamp of claim 1, further comprising a base to which said frame is attached, said base for supporting said frame.

4. The lamp of claim 3, wherein said frame is comprised of parallel tracks.

5. The lamp of claim 4, wherein the size and shape of said groove or grooves of said bulb holder are complementary to the size and shape of the confronting portions of said tracks.

6. The lamp of claim 1, wherein the size and shape of said aperture in said bulb holder corresponds to the size and shape of the cross-section of said bulb.

7. The lamp of claim 6, wherein said bulb holder is of an elastomeric material.

8. The lamp of claim 7, wherein said aperture in said bulb holder is defined by an interior wall, and said interior wall is contoured to have a nub, the diameter of said aperture defined by said nub being slightly less than the outside diameter of said bulb so that said nub is compressed when said bulb is inserted through said aperture to thereby securely hold said bulb.

9. The lamp of claim 7, wherein said bulb holder is a grommet.

10. The lamp of claim 1, wherein said bulb 13 is an elongated tube.

11. The lamp of claim 10, wherein said elongated tube is a neon tube.

12. The lamp of claim 10, wherein said elongated tube is a fluorescent tube.

13. A lamp for selectively supporting an elongated bulb in multiple positions, said lamp comprising a frame having substantially parallel tracks and a plurality of bulb holders removably attached to said frame at selected positions along said frame, said bulb holders each having one or more grooves for engaging said tracks when said bulb holder is fitted between said tracks, said bulb holders each further having an aperture for slidably receiving and holding said elongated bulbs, said elongated bulbs being selectively inserted through the apertures of more than one bulb holder such that each said elongated bulb is held by more than one bulb holder and is supported by said frame.

14. A lamp for selectively supporting a plurality of bulbs in multiple positions, said lamp comprising a frame having substantially parallel tracks and a plurality of bulb holders removably attached to said frame at selected positions along said frame, said bulb holders each having one or more grooves for engaging said tracks when said bulb holder is fitted between said tracks, said bulb holders each further having an aperture for slidably receiving and holding said bulbs, each of said bulbs being selectively inserted through the aperture of at least one of said bulb holders such that each bulb is held by at least one bulb holder and is supported by said frame.

15. The lamp of claim 14, wherein said bulbs are elongated tubes.

16. The lamp of claim 15, wherein said elongated tubes are neon tubes.

17. The lamp of claim 15, wherein said elongated tubes are fluorescent tubes.

18. The lamp of claim 13, wherein said elongated bulb is a neon tube.

19. The lamp of claim 13, wherein said elongated bulb is a fluorescent tube.

20. A lamp for selectively supporting an elongated bulb, said lamp comprising a frame having substantially parallel tracks and a bulb holder attached to said frame at a selected position along said frame, said bulb holder having one or more grooves for engaging said tracks when said bulb holder is fitted between said tracks, said bulb holder further having an aperture through which said elongated bulb is selectively inserted such that said bulb is held by said bulb holder and is supported by said frame.

21. A lamp for selectively supporting a plurality of bulbs in multiple positions, said lamp comprising a frame having substantially parallel tracks and a bulb holder removably attached to said frame at a selected position along said frame, said bulb holder having one or more grooves for engaging said tracks when said bulb holder is fitted between said tracks, said bulb holder further having a plurality of apertures for slidably receiving and holding said bulbs, each of said bulbs being selectively inserted through at least one of said apertures in said bulb holder such that each bulb is held by said bulb holder and is supported by said frame.

22. A lamp for selectively supporting an elongated bulb in multiple positions, said lamp comprising a frame of parallel tracks and a grommet having a groove about its perimeter and a central aperture for slidably receiving and holding said elongated bulb, said groove being complementary to the size and shape of the interior portions of said tracks and said aperture corresponding in size and shape to the cross-section of said elongated bulb, said grommet being selectively located along and fitted between said tracks such that said tracks engage said groove, said elongated bulb being inserted through said aperture of said grommet and selectively positioned therein such that said elongated bulb is held by said grommet and supported by said frame in a variety of positions.

23. The lamp of claim 3, wherein said frame and said base are shaped in elevation as a stylized numeral two.

24. The lamp of claim 2, wherein the tracks have a circular cross-sectional shape.

25. The lamp of claim 2, wherein the tracks have a square cross-sectional shape.

* * * * *